US005451967A

United States Patent [19]

Ueda et al.

[11] Patent Number: 5,451,967

[45] Date of Patent: Sep. 19, 1995

[54] ROOF ANTENNA WITH IMPROVED CASING

[75] Inventors: Shigeo Ueda, Urawa; Masahide Onoda, Saitama; Akio Kamiya, Warabi, all of Japan

[73] Assignee: Nippon Antenna Company Limited, Tokyo, Japan

[21] Appl. No.: 274,349

[22] Filed: Jul. 13, 1994

[30] Foreign Application Priority Data

Mar. 31, 1993 [JP] Japan ..... 6-083633
Jul. 30, 1993 [JP] Japan ..... 5-207013

[51] Int. Cl.[6] ..... H01Q 1/00; H01Q 1/32

[52] U.S. Cl. ..... 343/722; 343/715; 343/711

[58] Field of Search ..... 343/722, 715, 711, 850, 343/904, 906; 455/142, 143, 144; 439/916; H01Q 1/32, 1/00

[56] References Cited

U.S. PATENT DOCUMENTS

| | | | |
|---|---|---|---|
| 4,184,162 | 1/1980 | Grashow | 343/906 |
| 4,675,687 | 6/1987 | Elliott | 343/715 |
| 5,134,419 | 7/1992 | Egashira | 343/715 |
| 5,349,361 | 9/1994 | Egashira et al. | 343/722 |

FOREIGN PATENT DOCUMENTS

| | | |
|---|---|---|
| 2552271 | 3/1985 | France . |
| 4007824A1 | 9/1991 | Germany . |
| 4141783A1 | 6/1993 | Germany . |
| 57-17381 | 4/1982 | Japan . |
| 61-46601 | 3/1986 | Japan . |
| 61-49502 | 3/1986 | Japan . |
| 61-227405 | 10/1986 | Japan . |
| 63-42504 | 2/1988 | Japan . |
| 2239355 | 6/1991 | United Kingdom . |

OTHER PUBLICATIONS

Patent Abstract of Japan, vol. 11, No. 312(E-548), Oct. 12, 1987, JP-A-62,105,537 (Sasaki Kazutoshi et al.).

Patent Abstract of Japan, vol. 15, No. 394(E-1119), Oct. 7, 1991, JP-A-03,159,402 (Egashira Riyousui).

*Primary Examiner*—Donald Hajec
*Assistant Examiner*—Hoanganh Le
*Attorney, Agent, or Firm*—Armstrong, Westerman, Hattori, McLeland and Naughton

[57] ABSTRACT

A roof antenna capable of receiving three kinds of bands, i.e., a FM radio band, an AM radio band, and a wireless-telephone band, includes an antenna element 10 having a structure that a conductor 15 winds around the insulator 16 in the form of a coil. A molded portion 14 is formed at the bottom of the antenna element, in which a trap coil is inserted. The electric length from the antenna top 11 to the internal metal fitting 17 at the lower end of the antenna element 10 is about a quarter of a FM radio wave. The electric length from the internal metal fitting 17 to the lower end of the trap coil 12 is about a quarter of a wireless telephone wave. A cover 19 supporting a basal part of the antenna element installs the first substrate 20 and the second substrate 21. The first substrate 20 and the second substrate 21 have a matching circuit, branching filters, and amplifiers.

12 Claims, 13 Drawing Sheets

(a)

(b)

Fig.12
CONVENTIONAL ART
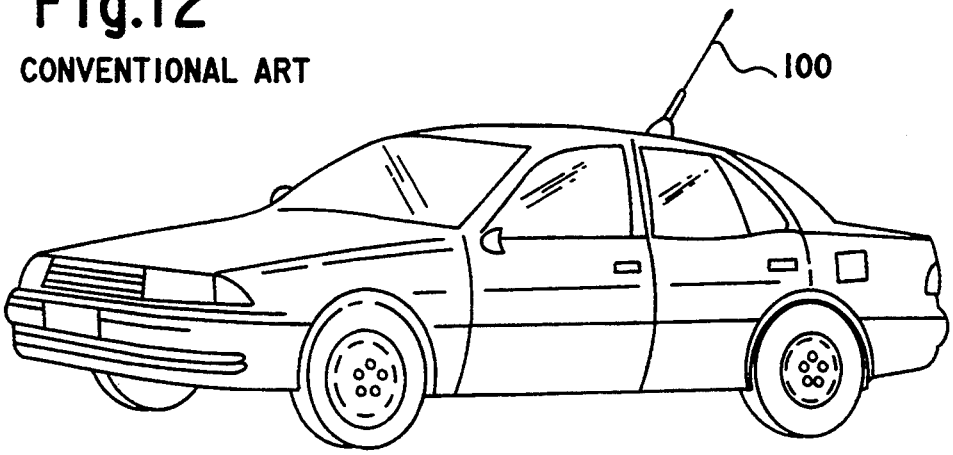
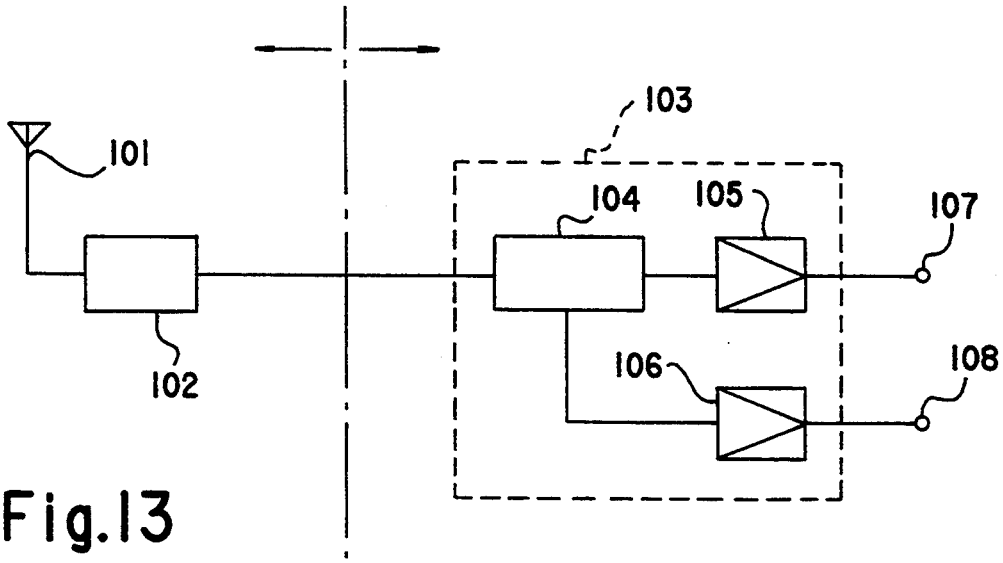
Fig.13
CONVENTIONAL ART

ROOF ANTENNA WITH IMPROVED CASING

BACKGROUND OF THE INVENTION AND RELATED ART STATEMENT

The present invention relates to a roof antenna set up on the roof of a car. In particular, the present invention relates to an antenna which can receive electric waves in three kinds of bands, i.e., a portable, wireless telephone band, a FM radio band, and an AM radio band.

There are various kinds of car antennas. Recently, a roof antenna set up on the roof of a car is popular because setting up an antenna at the highest place enhances the sensitivity. Since a FM radio and an AM radio are generally fixed inside a car, a roof antenna capable of receiving radio waves in both a FM radio band and an AM radio band has been spreading.

As shown in FIG. 12, such a conventional roof antenna 100 capable of receiving waves within two kinds of bands is fixed in the rear part of a car roof. FIG. 13 illustrates a circuit of the roof antenna 100. FIG. 14 shows an external appearance of the roof antenna 100 in detail.

As shown in FIG. 13, a signal received by the antenna element 101 fixed on a car roof is induced into the inside of a car through a matching circuit 102 and input to an amplifying unit 103 disposed in the car. Note that the matching circuit 102 works so that the antenna element 101 matches to a FM radio band.

Then, signals input to the amplifying unit 103 are branched into two kinds of signals, i.e. signals for a FM band and signals for an AM band by a branching filter 104, and both kinds of signals are amplified by amplifiers 105 and 106, respectively. The amplified FM signals are output from an output terminal 107 and induced into a FM receiver. The amplified AM signals are output from an output terminal 108 and induced into an AM receiver.

When a receiver can receive both AM and FM signals, signals which are output from an output terminal 107 or 108 are first mixed, and then, induced into an AM/FM receiver through a cable.

As shown in FIG. 14, this type of roof antenna has an antenna top 114 at the top end of an antenna element 113. The base portion of the antenna element 113 is molded to a basal part 112 of the antenna element. The basal part 112 of the antenna element is attached to a cover 111, thereby the antenna element 113 is supported by an antenna case. The cover 111 has the matching circuit 102 therein. The cover 111 and an antenna base 110 engaged with the cover: 111 constitute the antenna case. The antenna case is attached to a car roof.

A feed cable 116 drawn out of the matching circuit 102 in the antenna case is taken in the amplifying unit 103 disposed in a car. In the amplifying unit 103, waves are branched and amplified as shown in FIG. 13. The amplified FM signal is induced into a FM receiver through the first cable 117, and the amplified AM signal is induced into an AM receiver through the second cable 118.

When a receiver can receive both AM and FM signals, both AM and FM signals are first mixed, and then, induced into an AM/FM receiver through a cable.

In the conventional roof antenna, the antenna case has only a matching circuit 102. The reason why the amplifying unit 103 is disposed outside of the antenna case is that the size of a projecting part outside a car is regulated in Europe to be not more than 40 mm in height and not less than 2.5 of R(radius of curvature) of the projecting part. This regulation is applied to the size of an antenna case excluding the antenna element, and the size of the antenna case is required to be controlled so as to clear the aforementioned regulation. Therefore, the antenna case could not increase its size, and the amplifier 103 could not be installed in the antenna case. In addition, a large projecting part generally mars the beauty of the external appearance of a car.

As described above, the cover 111 has the matching circuit 102 therein. In order to connect the matching circuit 102 to the antenna dement 113 electrically, a metal fitting for connecting an antenna element is arranged on top of the cover 111. The basal part of the antenna element is fixed on the cover 111 by means of the metal fitting. The metal fitting is connected with the matching circuit 102 inside the cover 111. Thus, the antenna element 113 is connected to the matching circuit 102 electrically.

FIGS. 15 (*a*) (*b*) (*c*) shows the structure of connecting the aforementioned metal fitting with the matching circuit 102 as conventional examples.

FIG. 15(*a*) shows that one end of a connecting piece 121 consisting of lead wire is connected, by soldering, to a substrate 119 having the matching circuit 102. The other end of a connecting piece 121 is connected to the bottom surface of the metal fitting 120. A soldering iron is inserted into the space between the cover 111 and the substrate 119 for soldering. The lead wire as a connecting piece 121 is long enough to leave a margin because the soldering is conducted before the cover 111 covers the antenna base 110.

FIG. 15(*b*) shows that one end of a connecting piece 121 is connected, by soldering, to a substrate 119 having a matching circuit 102. The other end of the connecting piece 121 is subjected to screw cutting. Then, the cover 111 is fixed to the antenna base 110, followed by screwing the connecting piece to the metal fitting 120 from the central hole of the metal fitting 120. Thus the metal fitting 120 for connecting an antenna element is electrically connected with the connecting piece 121.

FIG. 15(*c*) shows that one end of a connecting piece 121, which is made of elastic metal, is connected, by soldering, to a substrate 119 having a matching circuit 102. When the cover 111 having the metal fitting 120 engages with the antenna base 110, the other end of the connecting piece 121 contacts with the bottom of the metal fitting 120 so as to obtain electrical connection.

However, a conventional roof antenna has some problems, i.e., a conventional roof antenna requires the space for storing the amplifying unit, and the setup of the amplifying unit or the like requires complex handling.

Further, since a conventional roof antenna cannot receive electromagnetic waves in a wireless telephone band, a car loaded with a wireless telephone requires another antenna.

Furthermore, many problems arise in the structures shown in FIG. 15(*a*)(*b*)(*c*). As for the structure in FIG. 15(*a*), when the connecting piece is soldered to the metal fitting, it is prone to melt the cover made of synthetic resins. In addition, this structure requires that the connecting piece is long enough to leave a margin because the soldering is conducted before the cover is fixed to the antenna base. The structure has a problem that the length of an antenna up to a matching circuit is not regularized.

As for the structure in FIG. 15(*b*), moisture penetrates into the cover through the hole for a positive screw and corrodes the substrate and the like. As for the structure in FIG. 15(*c*), the metal fitting and the connecting piece are electrically connected by only contacting with each other. Therefore, the contact is unstable and prone to be disturbed by moisture penetrating into the cover for some reason.

SUMMARY OF THE INVENTION

One object of the present invention is to ease the handling of an antenna by a structure that allows only cable is to be led into a car. Another object of the present invention is to provide a roof antenna capable of receiving electromagnetic waves in the band for a wireless telephone besides radio waves in AM and Fm radio bands.

Still another object of the present invention is to provide a structure in which the metal fitting for connecting an antenna element is stably connected to the substrate having a matching circuit installed inside a cover.

To achieve the aforementioned objects, a matching circuit and an amplifying unit are installed in the cover to which a basal part of the antenna element is fixed, and an antenna element has a trap coil so that radio waves in a wireless telephone band also can be received in the present invention. That is, the present invention provides a roof antenna capable of receiving three kinds of bands, comprising: an antenna element having a trap coil in the middle thereof; and an antenna case, fixed on the roof of a car, installing a branching filter means, amplifiers, and a mixer; wherein the antenna element is constituted so that an electric length from the bottom end of the antenna to the trap coil is resonant with signals having the first frequency, an electric length from the bottom end of the antenna to the antenna top is resonant with signals having the second frequency, an electric length of the whole antenna element receives signals having the third frequency; the branching filter means branches and outputs the signals having the first frequency from three kinds of bands; the signals having the second frequency and the signals having the third frequency branched by said branching filter means are amplified respectively by the amplifiers; and the amplified signals having the second frequency and the third frequency are mixed by the mixer and output from the antenna case.

Further, in the present invention, an internal engaging portion is formed at the bottom of the metal fitting connected with the cover, and an external engaging portion is formed on a metal connecting piece fixed on the substrate having a matching circuit. Thus, the metal fitting is engaged with the connecting piece by push-and-lock system. The present invention further provides a roof antenna capable of receiving three kinds of bands comprising: an antenna case fixed on the roof of a car; and an antenna element capable of receiving three kinds of bands, fixed to the antenna case; wherein the antenna case comprises a cover and a base; a metal fitting portion for connecting an antenna element, having a depression is fixed watertightly at the top portion of the cover so that the depression faces the outside, the metal fitting having an internal engaging portion at the bottom thereof; a metal connecting piece is electrically connected with a substrate fixed to the base; an external engaging portion is formed at one end of the metal connecting piece by making cuts in radial directions so as to have tongues bent downward; and the cover is pressed to insert the internal engaging portion of the metal fitting for connecting an antenna element engages into the external engaging portion so that the metal fitting for connecting an antenna element is electrically connected to the substrate.

Furthermore, in the present invention, a plurality of substrates are installed in an antenna case so that a matching circuit and an amplifying unit is installed in the antenna case having a small space. The present invention still further provides a roof antenna capable of receiving three kinds of bands comprising: an antenna element having a trap coil in the middle thereof; and an antenna case having a portion for fixing the antenna element, the antenna case installing a substrate comprising a branching filter means, amplifiers and a mixer, and being fixed on the roof of a car, wherein the antenna element is constituted so that an electric length from the bottom end of the antenna to the trap coil is resonant to signals having the first frequency, an electric length from the bottom end of the antenna to the antenna top is resonant with signals having the second frequency, and an electric length of the whole antenna element is resonant with signals having the third frequency; and the antenna case comprises a cover and a base; a metal fitting having a depression is fixed watertightly at the top portion of the cover so that the depression faces the outside; the metal fitting has an internal engaging portion at the bottom thereof; and a metal connecting piece is electrically connected with the substrate fixed to the base; an external engaging portion is formed at one end of a metal connecting piece by making cuts in radial directions to form tongues bent downward; and the cover is pressed to insert the internal engaging portion of the metal fitting for connecting an antenna element into the external engaging portion so that the metal fitting for connecting an antenna element is electrically connected to the substrate; the branching filter means branches and outputs the signals having the first frequency from three kinds of bands; the signals having the second frequency and the signals having the third frequency branched by the branching filter means are amplified respectively by the amplifiers; and the amplified signals having the second frequency and the third frequency are mixed by the mixer and output from the antenna case.

In the present invention, the branching filter means comprises at least one branching filter. According to the present invention, an amplifying unit is installed in the small space surrounded by a cover and an antenna base. Therefore, only a cable is led into the inside of a car, and the space for installing an amplifying unit is not required in a car. Further, the antenna can be used for three kinds of electric waves since an antenna element has a trap coil.

Further, the structure gives an electrically stable connection and does not have a gap from which moisture penetrates because the metal fitting for connecting an antenna element is engaged with the connecting piece by push-and-lock system. Therefore, a reliable electrical connection can be maintained.

BRIEF DESCRIPTION OF THE DRAWINGS

FIG. 12 shows an embodiment of fixing a roof antenna on the roof of a car.

FIG. 13 is a circuit diagram of a conventional roof antenna capable of receiving two kinds of electric waves.

DETAILED DESCRIPTION OF THE PREFERRED EMBODIMENT

Figure 1:
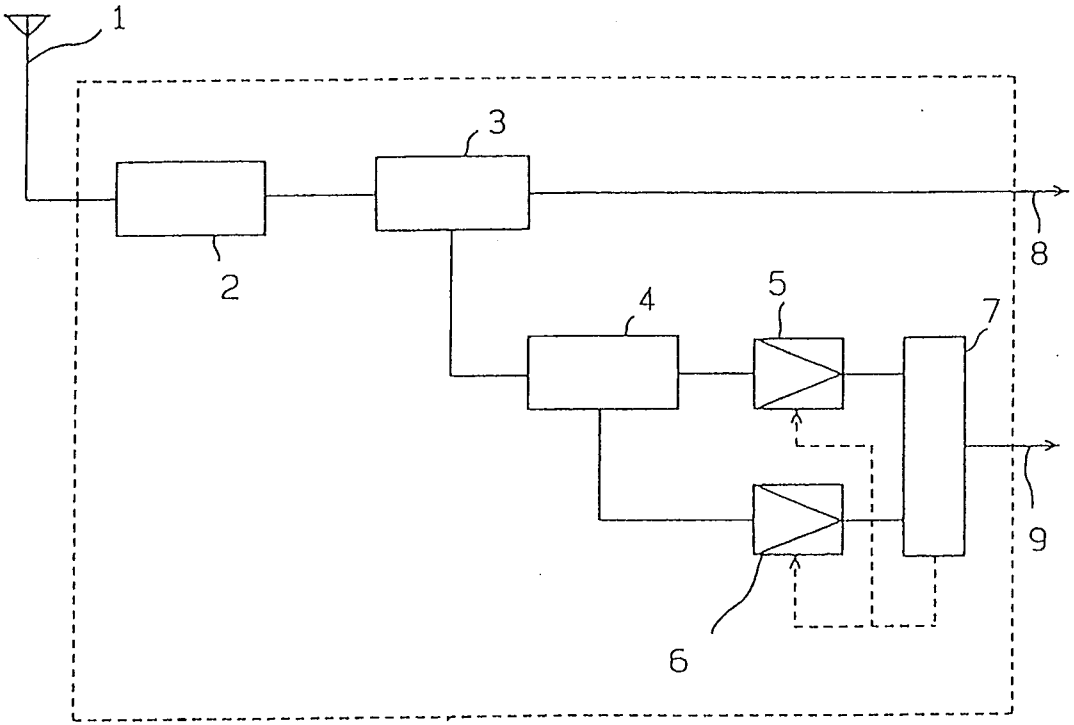
FIG. 1 shows a circuit diagram of a roof antenna capable of receiving three kinds of waves of the present invention.

FIG. 1 shows a circuit diagram of an example of a roof antenna capable of receiving three kinds of electric waves of the present invention.

As shown in FIG. 1, signals received by an antenna element 1 are input to a branching filter 3 through a matching circuit 2. The signals are branched into two, i.e., signals in a wireless telephone band and signals in FM/AM bands by the branching filter 3. The signals in a wireless telephone band are output from the first cable 8 and supplied to a wireless telephone. The signals in FM/AM bands are further branched into two, i.e. signals in FM radio band and signals in AM radio band by a branching filter 4. The signals in FM radio band are amplified by an amplifier 5 and input to a mixer 7, and the signals in AM radio band are amplified by an amplifier 6 and input to a mixer 7.

Further, the signals for FM radio band and the signals for AM radio band are mixed by the mixer 7, output from the second cable 9, and supplied to an AM/FM receiver.

The circuit surrounded by the broken line in the figure is installed in the space inside the antenna case constituted by an antenna base and a cover. The circuit is fixed on, for example, two substrates.

Incidentally, the power is supplied to the amplifier 5 and the amplifier 6 through the second cable 9 as shown by the broken line.

Figure 2:
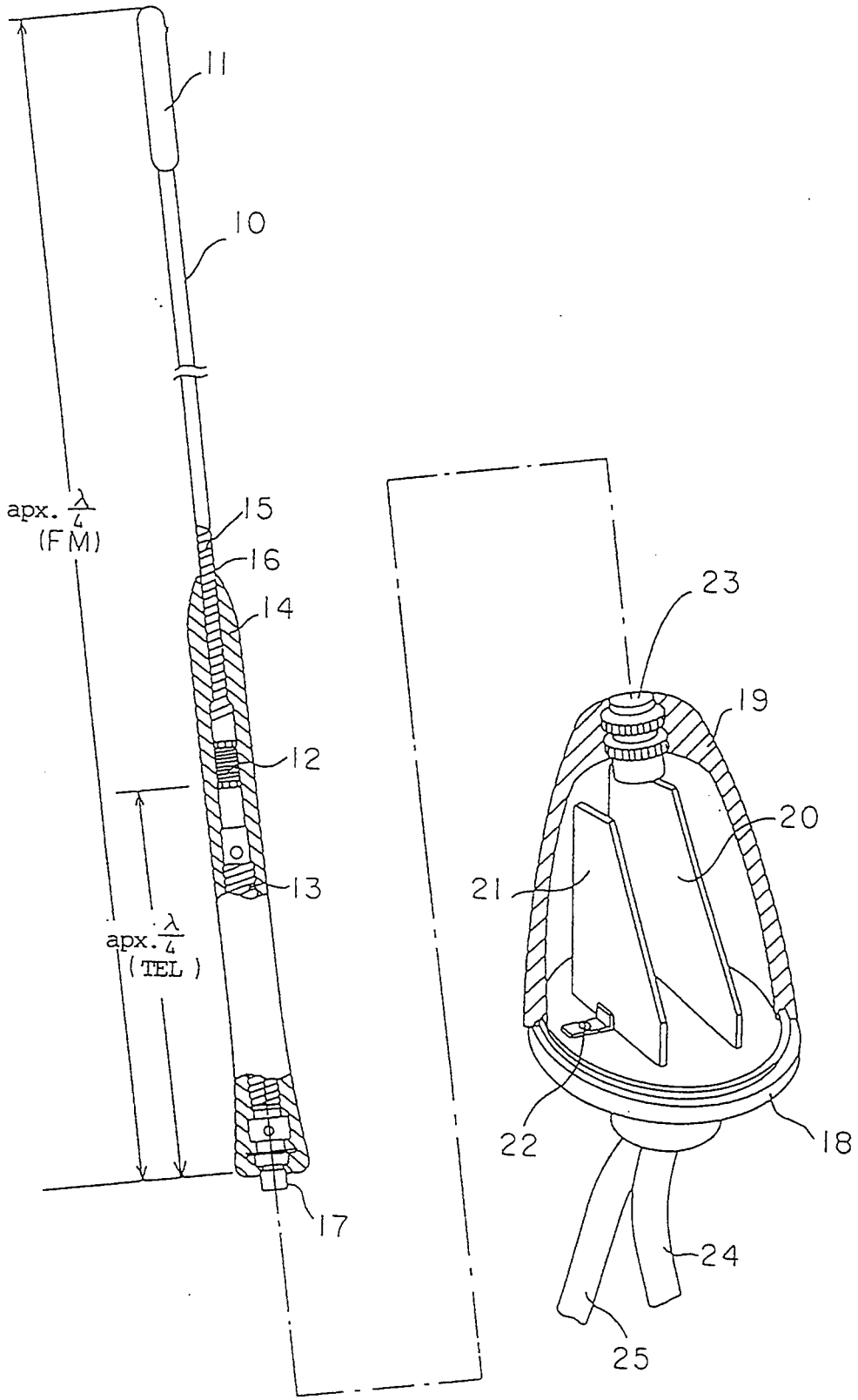
FIG. 2 shows an external appearance of a roof antenna capable of receiving three kinds of electric waves of the present invention.

FIG. 2 shows an external appearance of a roof antenna of the present invention.

In FIG. 2, an antenna element 10 has a structure that a conductor 15 winds around an insulating material 16 in the form of a coil. The antenna element 10 has an antenna top 11 on top thereof. The lower end of the antenna element 10 is molded with synthetic resins having elasticity such as rubber so as to form a molded portion 14. Inside the molded portion 14, a trap coil 12 is inserted into the antenna element 10 and connected to the antenna element 10. The trap coil 12 is further connected to a coil spring 13 which is a part of the antenna element. The coil spring 13 is fixed to a internal metal fitting 17 arranged at the lower end of the coil spring. The internal metal fitting 17 is threadably attached to a metal fitting 23 for connecting an antenna element 23.

The molded portion 14 having the aforementioned coil spring 13 therein is flexible enough to absorb an external force so as to prevent the antenna element 10 from snapping off.

The length from the antenna top 11 of the antenna element 10 to the internal metal fitting 17 at a bottom end of an, antenna is about a quarter of the wavelength of a FM radio band. The length from the internal metal fitting 17 to the lower end of the trap coil 12 is about a quarter of the wavelength of a wireless telephone band.

The antenna cover 19 tightly holding an antenna element has a metal fitting 23 for connecting an antenna element watertightly. The cover 19 is engaged with the antenna base 18. The inner volume of the space formed by the antenna cover 19 and the base 18 is about 30 cc. The first substrate 20 and the second substrate 21 are installed in the cover 19. Further, the metal fitting 23 is electrically connected with the first substrate 20. The first substrate has, for example, a matching circuit 2 and a branching filter 3. A branching filter 4, an amplifier 5, an amplifier 6, and a mixer 7 are mounted on the second substrate 21. These substrates 20 and 21 are fixed to the antenna base 18 by an angle joint 22. The first cable 24 and the second cable 25 are led from the antenna base 18 so as to be connected to a telephone and an AM/FM receiver, respectively.

The first substrate 20 and the second substrate 21 is disposed perpendicularly to the base 18. Each of the substrates has a shape along the inner surface of the antenna cover 19. The embodiment has two substrates. However, the antenna case may have more than two substrates.

The structure for electrically connecting the metal fitting 23 connected with the cover with the first substrate 20 is described hereinbelow on reference to FIG. 3(*a*)(*b*)(*c*). Note that the second substrate 21 is omitted from this figure.

Figure 3:
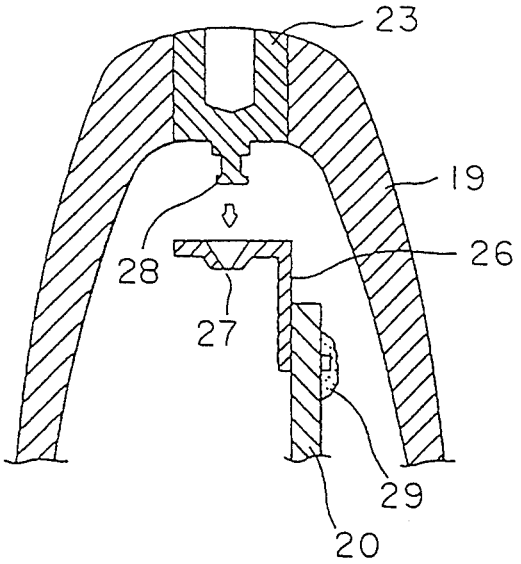
FIGS. 3(*a*)(*b*)(*c*) shows a structure of an engagement of a metal fitting for connecting an antenna element with a metal connecting piece of the present invention.
Figure 3:
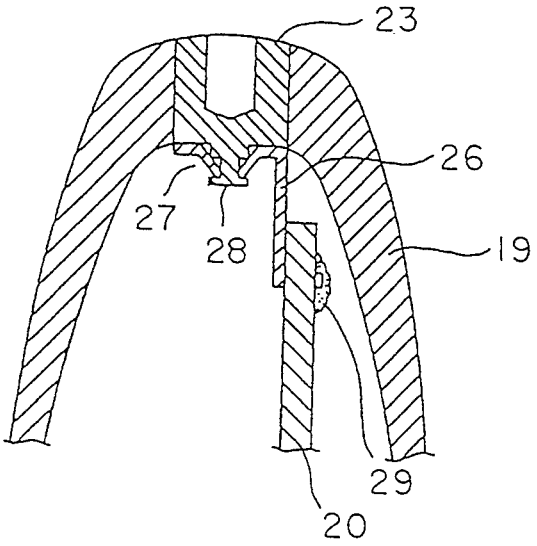
Figure 3:
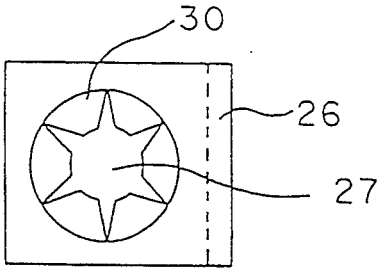

As shown in FIG. 3(*a*), one end of a metal connecting piece 26 having a shape of L is fixed to the substrate 20 by soldering. On the other end of a metal connecting piece 26, an external engaging portion 27 is arranged. The external engaging portion 27 is formed by making cuts in radial directions to form tongues 30 as shown in FIG. 3(*c*). The tongues 30 are bent so as to form the external engaging portion 27.

At the bottom of the metal fitting 23 for connecting an antenna element, a cylindrical internal engaging portion 28 is arranged. This internal engaging portion 28 is a projection having a cylindrical shape with necking. To engage the internal engaging portion 28 with the external portion 27 of the metal connecting piece, the cover 19 is positioned over the antenna base 18 so that the portion 28 can match the portion 27. When the cover 19 is pushed downward as shown by an arrow, the cylindrical portion 28 is inserted into the portion 27 with pushing the tongues 30, and the end of the tongues are caught by the neck of the internal engaging portion 28. At the same time, the cover 19 is engaged with the antenna base 18.

This system of engagement is called a push-and-lock system, which has realized the electrically stable and reliable connection.

Figure 4A:
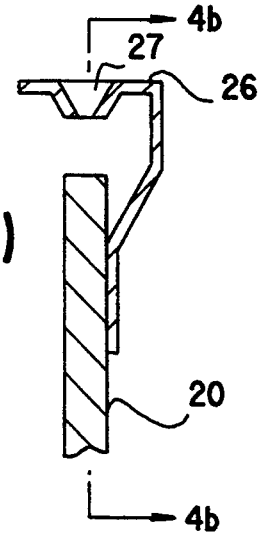
FIGS. 4(*a*)(*b*)(*c*) shows another structure of an engagement of a metal fitting for connecting an antenna element with a metal connecting piece of the present invention.
Figure 4B:
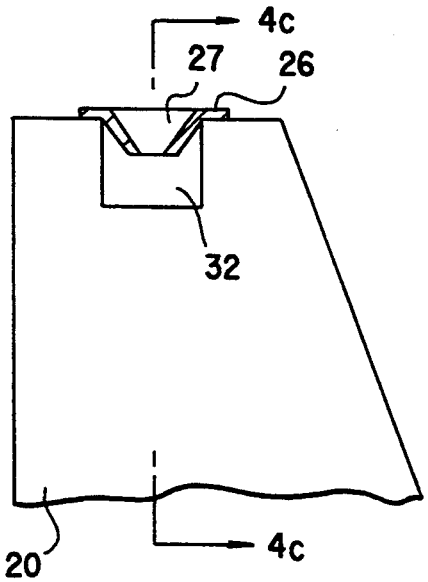
Figure 4C:
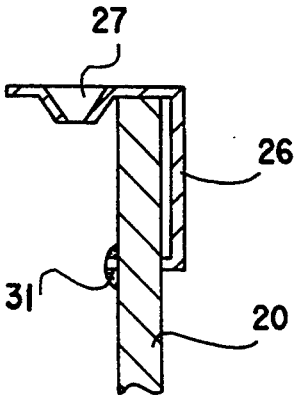

FIGS. 4(*a*)(*b*)(*c*) illustrates other examples of connecting the metal fitting 23 and the metal connecting piece 26.

An example is shown in FIG. 4(*a*) and FIG. 4(*b*). In FIG. 4(*a*), the metal connecting piece 26 is formed so that the external engaging portion 27 is positioned just above the first substrate 20. The external engaging portion 27 is arranged at one end of the metal connecting piece 26. The metal connecting piece 26 is fixed on the first substrate 20 at the other end. FIG. 4(*b*) is a cross-sectional view at the line A—A in FIG. 4(*a*). As shown in FIG. 4(*b*), the first substrate 20 has a depression 32, in which the internal engaging portion 27 of the metal connecting piece 26 is placed. A cross-sectional view at the line B—B in FIG. 4(*b*) is FIG. 4(*a*).

Thus, the metal connecting piece 26 is supported by the first substrate 20 in the example shown in FIGS. 4(*a*) and 4(*b*). Therefore, the metal connecting piece 26 is not bent when the external engaging portion 27 is pressed by the internal engaging portion on the metal fitting 23, thereby the metal connecting piece 26 and the metal fitting 23 are easily engaged with each other.

Another example of connecting the metal fitting 23 with the metal connecting piece 26 is shown in FIG. 4(*c*).

The metal connecting piece 26 is formed so as to partially surround the first substrate 20 as being illustrated. One end of the metal connecting piece 26 is soldered to the substrate 20. Therefore, the metal connecting piece 26 can engage with the metal fitting 23 without bending even when the external engaging portion 27 is pressed because the first substrate 20 supports the metal connecting piece 26 for reinforcement.

Figure 5:
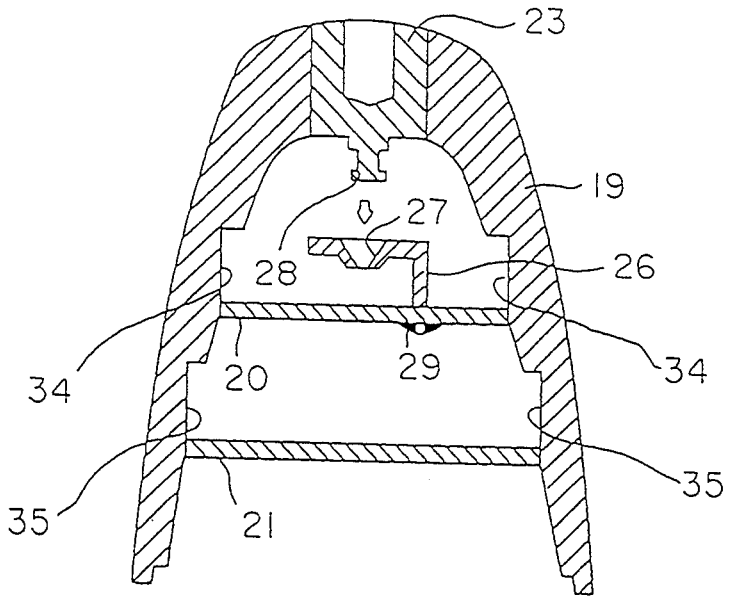
FIG. 5 shows an embodiment of installing a plurality of substrates in an antenna case.
Figure 6:
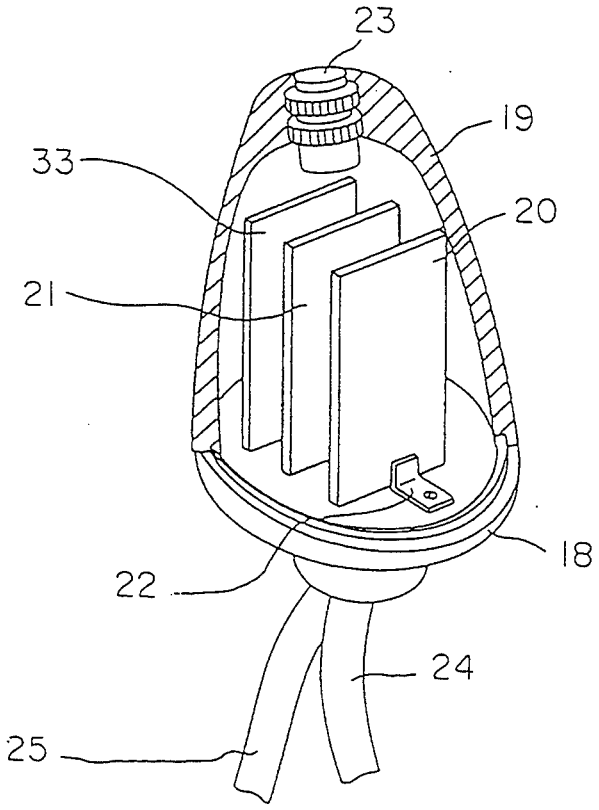
FIG. 6 shows another embodiment of installing a plurality of substrates in an antenna case.

Each of FIGS. 5 and 6 shows another embodiment of an antenna case having a plurality of substrate therein.

In the structure of the substrates shown in FIG. 5, both the first substrate 20 and the second substrate 21 have a round shape along the inner surface of the cover. These substrates 20 and 21 are installed in the antenna case so as to be parallel to the unillustrated base 18. Further, the metal fitting 23 is pressed down so that the internal engaging portion 28 engages with the external engaging portion 27, and thereby the metal fitting 23 is electrically connected to the first substrate 20. The first substrate 20 has, for example, a matching circuit 2 and a branching filter 3. The second substrate 21 has, for example, a branching filter 4, an amplifier 5, an amplifier 6, and a mixer 7. These substrates 20 and 21 abut, at their circumferences, on the notches 34 and 35 each having a shape of ring, respectively, when the cover 19 engages with a base 18. That is, the first substrate 20 abuts on the first notch 34, and the second substrate 21 abuts on the second notch 35. In this figure, the antenna case has two substrates, i.e., the first substrate 20 and the second substrate 21. However, the antenna case may have more than two substrates.

In the structure shown in FIG. 6, the substrates 20, 21, and 33 are disposed perpendicularly to the base 18. Though the disposition of the substrates 20 and 21 shown in FIG. 2 are similar to that of the substrates in FIG. 2, the substrates 20, 21, and 33 are fixed on the base in the manner of rotating in 90°. Further, the metal fitting 23 is pressed onto the connecting piece 26 attached on either the first substrate 20 or the third substrate 33 so that the connecting piece 26 is electrically connected with one of the substrates. The matching circuit 2, branching filters 3 and 4, amplifiers 5 and 6, and a mixer 7 are divided into two and disposed on the first substrate 20 and the third substrate 33. These substrates are fixed on the base by angle joints 22.

In this figure, each of the substrates has a shape of square. However, a substrate having a shape along the inner surface of the cover 19 can have a larger surface area, and becomes suitable for an antenna case having a low height. The number of the substrates is not limited to three, and two substrates or more than three substrates may be installed in the antenna case.

Figure 7:
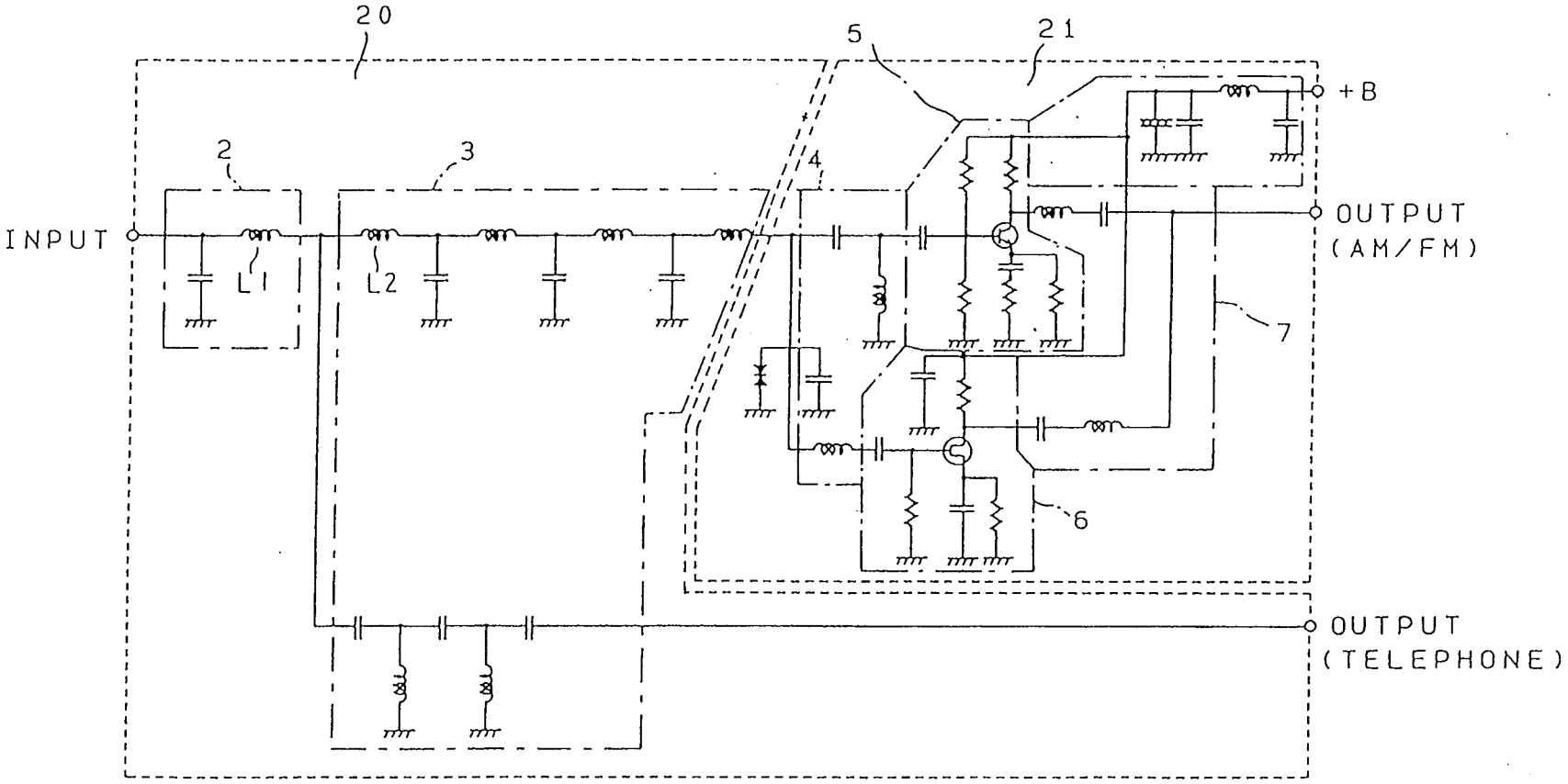
FIG. 7 is a detailed circuit diagram of a roof antenna capable of receiving three kinds of electric waves of the present invention.

FIG. 7 shows the details of the circuit shown in FIG. 1.

In the circuit shown in FIG. 7, a matching circuit 2 including an inductor and a capacitor is connected to an Input. A branching filter 3 is connected to the matching circuit 2. The branching filter 3 includes a high-pass filter and a low-pass filter. The low-pass filter having inductors in a cascade connection in series and capacitors branches signals for an AM/FM radio band. The high-pass filter having capacitors in a cascade connection in series and inductors branches signals for a wireless telephone band.

The branched signals for a wireless telephone band are output from Output (telephone). The branched signals for an AM/FM radio band are input to a branching filter 4. In the branching filter 4, a high-pass filter having a capacitor in a cascade connection branches the signals in a FM radio band, and a low-pass filter having an inductor in a cascade connection branch the signals in an AM radio band. The branched signals in a FM radio band are amplified by an amplifier 5, and the branched signals in an AM radio band are amplified by an amplifier 6.

The amplifier 5 outputs the signals in a FM radio band, and the amplifier 6 outputs the signals in an AM radio band. Both kinds of signals are mixed by a mixer 7, followed by being output from Output (AM/FM).

Power is applied to +B, and the power is supplied to the amplifier 5 and the amplifier 6 through a power-branching filter. When the +B line is connected to Output (AM/FM), the power can be supplied to the amplifier 5 and the amplifier 6 by sharing the line for Output (AM/FM).

The circuit shown in FIG. 7 is mounted on the surface of the substrates each having a shape along the inner surface of the cover 19 so that the circuit can be installed in a miniaturized antenna case having a capacity of about 30 cc. When a wireless telephone has a high transmitting output, coils of the matching circuit 2 and the branching filter 3 are prone to damage by burning. Therefore, the coil L1 of the matching circuit and the coil L2 of the branching filter are made of thick wire without any core.

Figure 8:
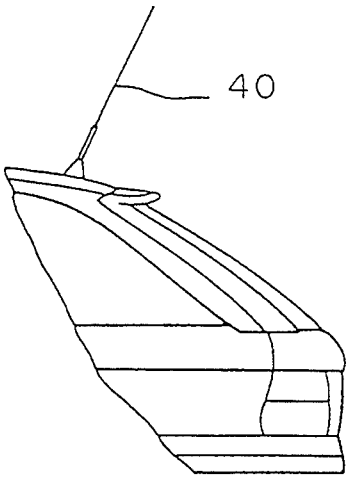
FIGS. 8(*a*)(*b*) shows a means of fixing on a car roof a roof antenna capable of receiving three kinds of electric waves of the present invention.
Figure 8:
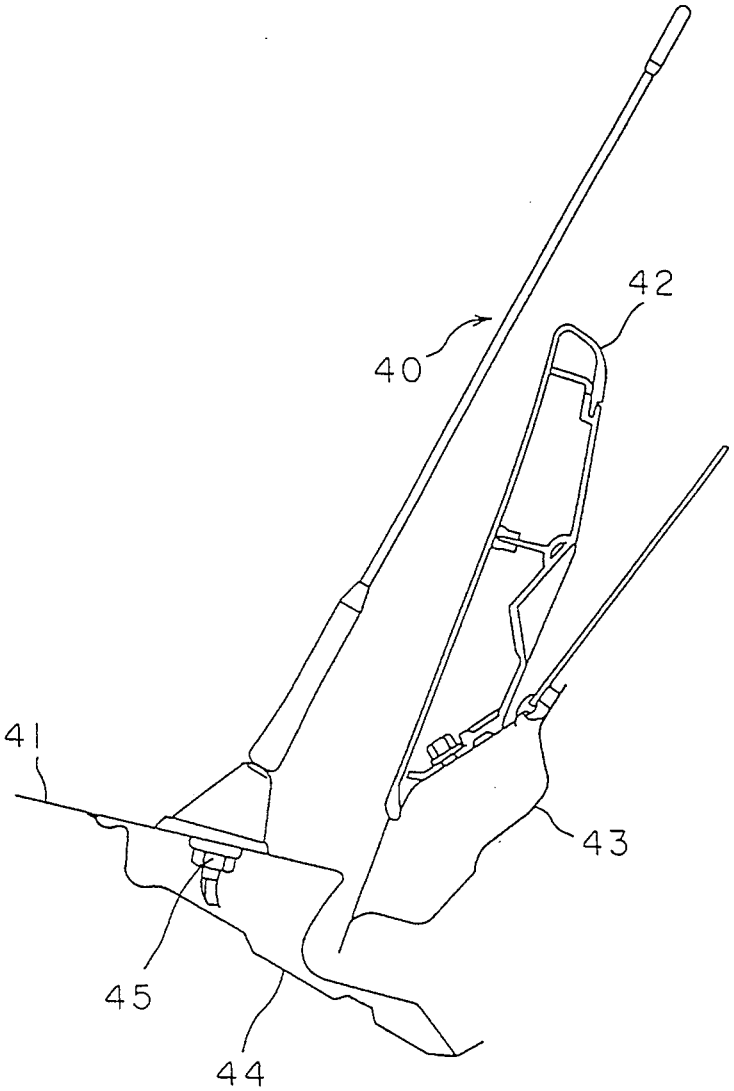

The aforementioned roof antenna of the present invention is fixed on the roof of a car at its rear end, for example, as shown in FIG. 8(*a*). FIG. 8(*b*) shows a magnified cross-sectional view of the portion where the roof antenna is fixed. As show in this figure, the roof antenna 40 is fixed on the roof 41 of a car by a fixing means 45. The fixing means 45 is installed in a space between the car roof 41 and a reinforcing plate 44. 42 denotes a rear spoiler, and 43 denotes a tail gate.

Figure 14:
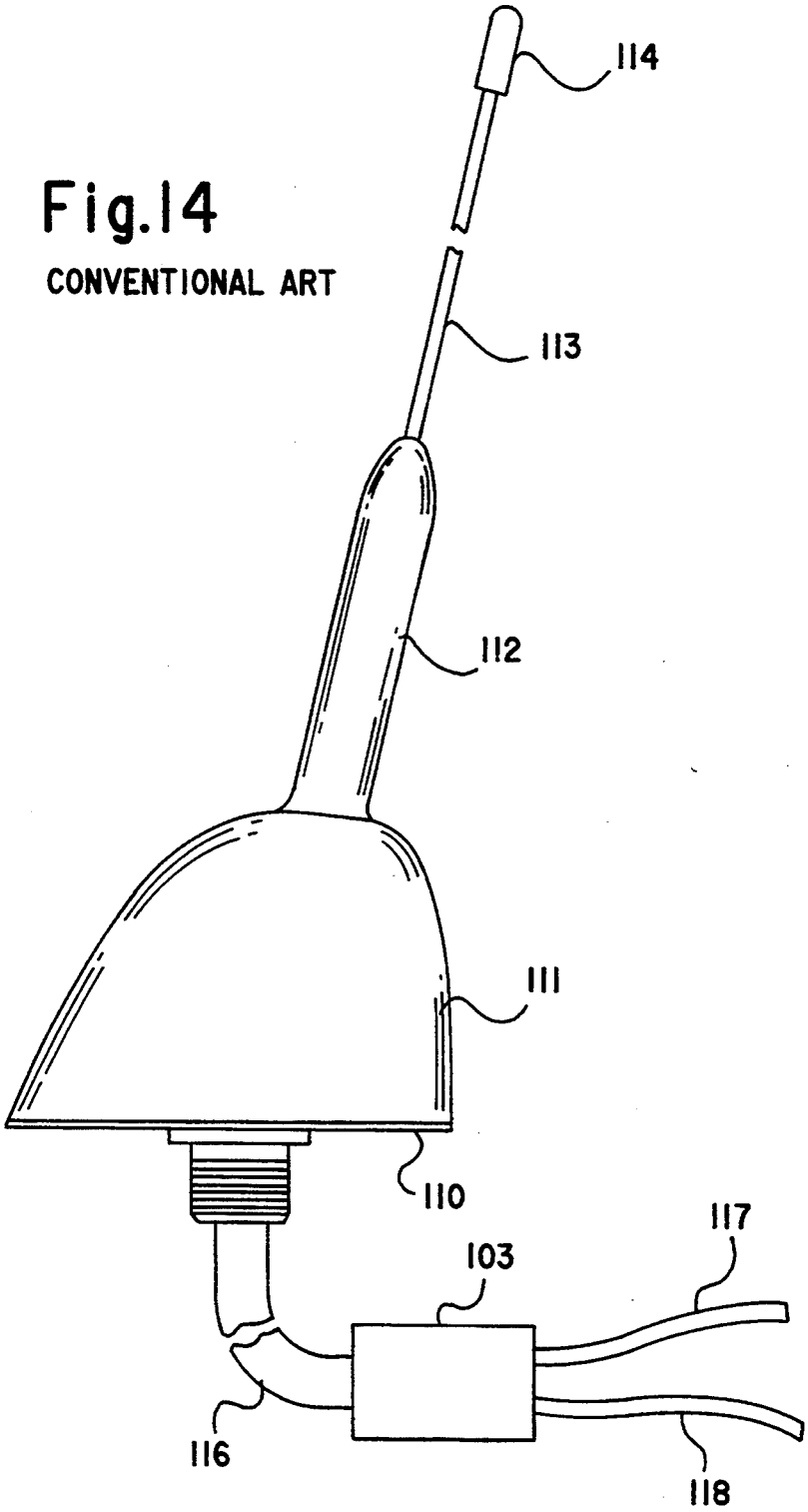
Fig.14 CONVENTIONAL ART
FIG. 14 illustrates an external view of a conventional roof antenna capable of receiving two kinds of electric waves.
Figure 15A:
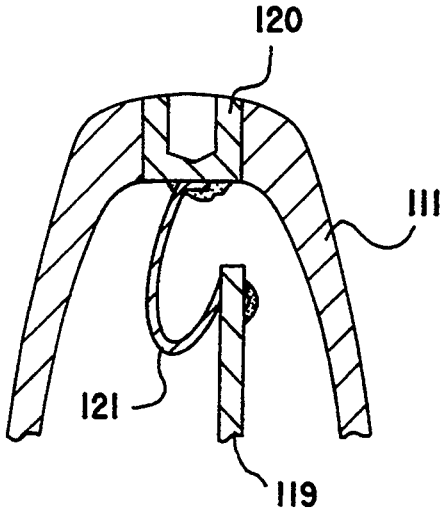
Fig.15(a) CONVENTIONAL ART
FIGS. 15 (*a*) (*b*) (*c*) illustrates structures of conventional engagements of a metal fitting for connecting an antenna element with a connecting piece.
Figure 15B:
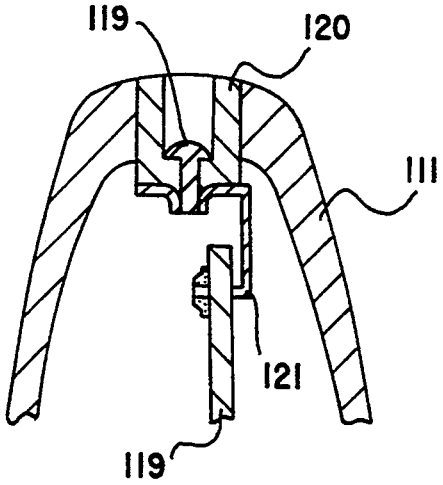
Fig.15(b) CONVENTIONAL ART
Figure 15C:
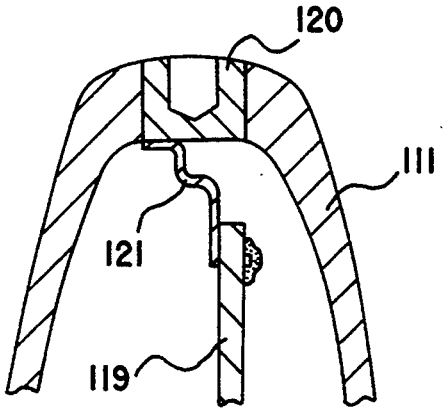
Fig.15(c) CONVENTIONAL ART

As to the conventional roof antenna for two kinds of radio waves shown in FIG. 14, an amplifying unit 103 requires to be installed in a car. The shape of the amplifying unit 103 limits the place for fixing the amplifying unit 103. Since the amplifying unit 103 cannot be installed in the space between the roof 41 and the reinforcing plate 44, it is disposed inside the car room out of the space between the roof 41 and the reinforcing plate 44. It made the lead of a cable difficult. However, according to the present invention, only cables are required to be led out of the antenna case. It makes the lead of cables easy.

The properties of the roof antenna, capable for receiving three kinds of bands, fixed on the roof as shown in FIG. 8 is described hereinbelow in comparison with those of a conventional antenna on reference to the FIGS. 9–11.

Figure 9:
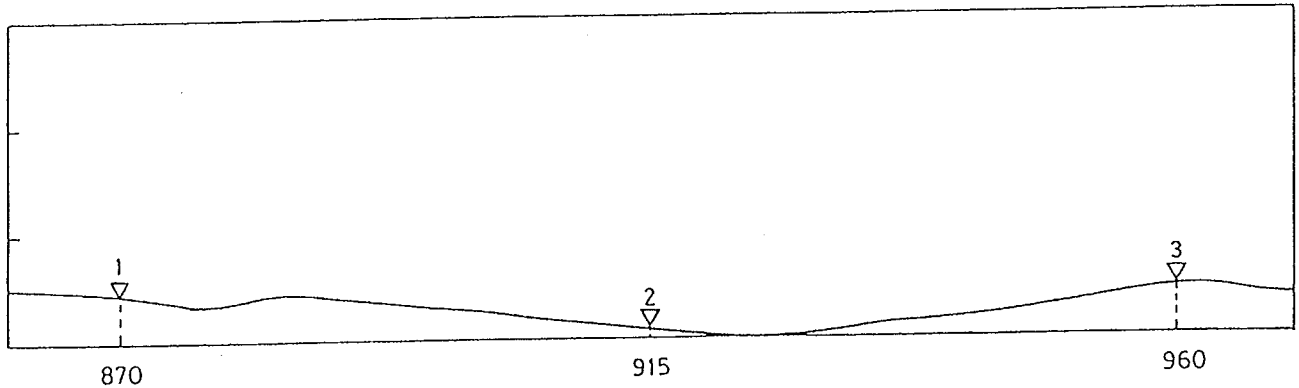
FIGS. 9(*a*)(*b*) shows the difference of a VSWR property between a roof antenna of the present invention and a conventional antenna for an exclusive wireless-telephone band.
Figure 9:
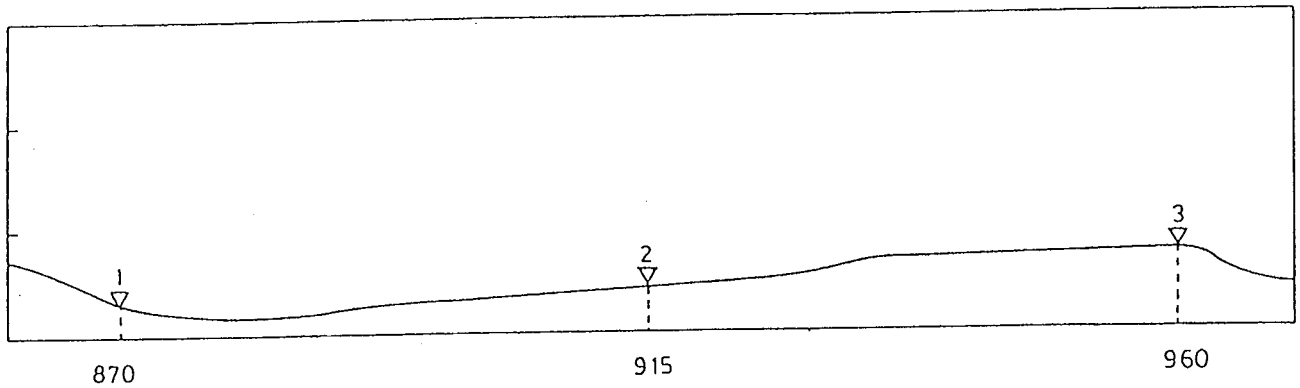

FIGS. 9(*a*)(*b*) shows the difference of a voltage standing wave ratio (VSWR) property in the frequency of a wireless-telephone band. Regarding the roof antenna of the present invention, as shown in FIG. 9(*a*), VSWR at the point 1 having a frequency of 870 MHz is about 1.43, VSWR at the point 2 having 915 MHz is about 1.10, and VSWR at the point 3 having 960 MHz is about 1.48. The data show the excellent property of the roof antenna of the present invention.

The antenna for a wireless-telephone band is fixed on the roof besides a conventional roof antenna for two bands. As shown in FIG. 9(*b*), VSWR at the point 1 having 870 MHz is about 1.16, the point 2 having 915 MHz is about 1.23, and VSWR at the point 3 having 960 MHz is about 1.42. This indicates that the antenna of the present invention has an equal efficiency with an antenna only for a wireless-telephone.

Figure 10A:
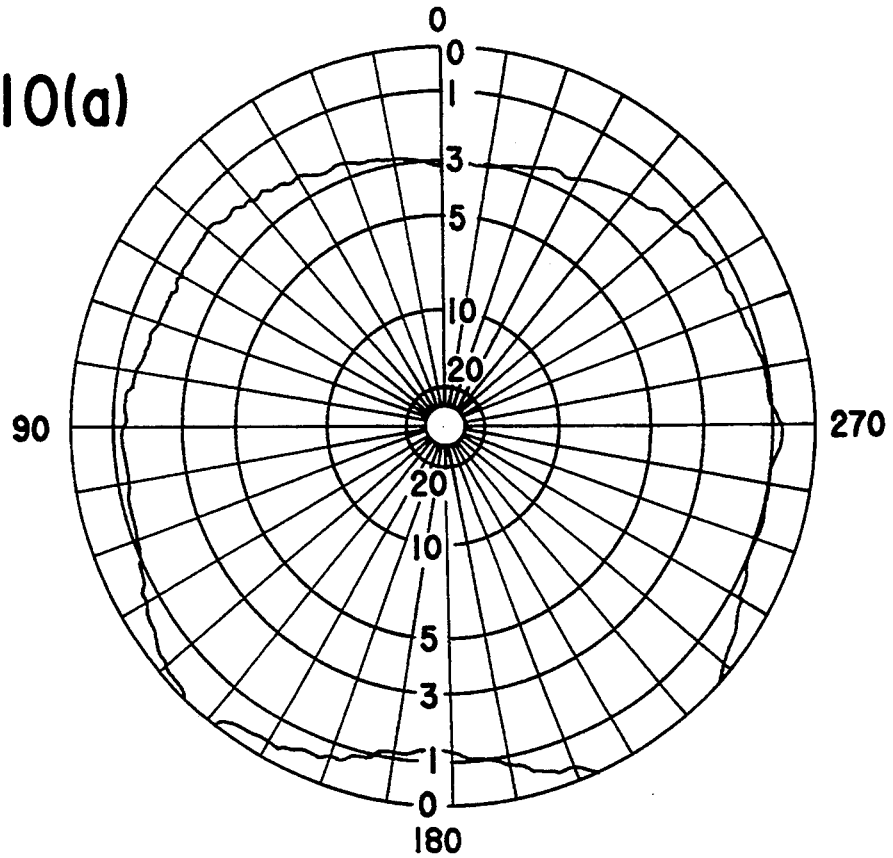
FIGS. 10(*a*)(*b*) shows the difference of horizontal directivity between a roof antenna of the present invention and a conventional antenna for an exclusive wireless-telephone band.
Figure 10B:
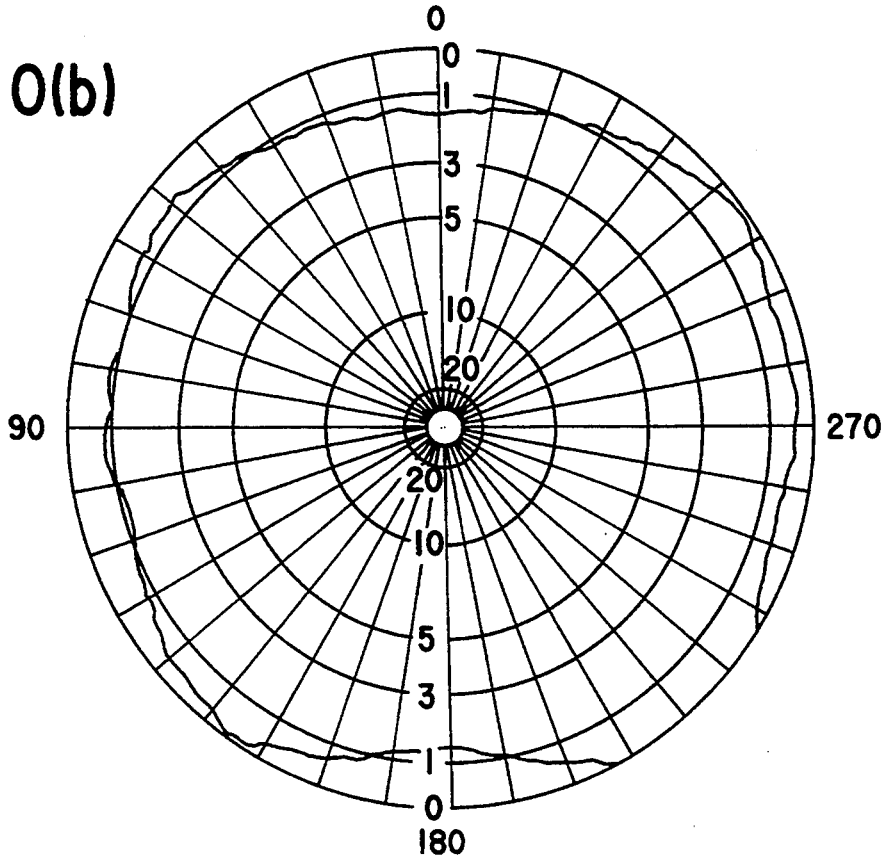

FIGS. 10(*a*)(*b*) shows a horizontal directivity when a frequency is 960 MHz. FIG. 10(*a*) shows the property of a roof antenna of the present invention. FIG. 10(*b*) shows the property of a conventional roof antenna only for a wireless telephone. The comparison shows that the roof antenna of the present invention has about the equal efficiency with a conventional antenna only for a wireless telephone though the roof antenna of the present invention is a little inferior to the conventional antenna in nondirectivity as a whole.

Figure 11A:
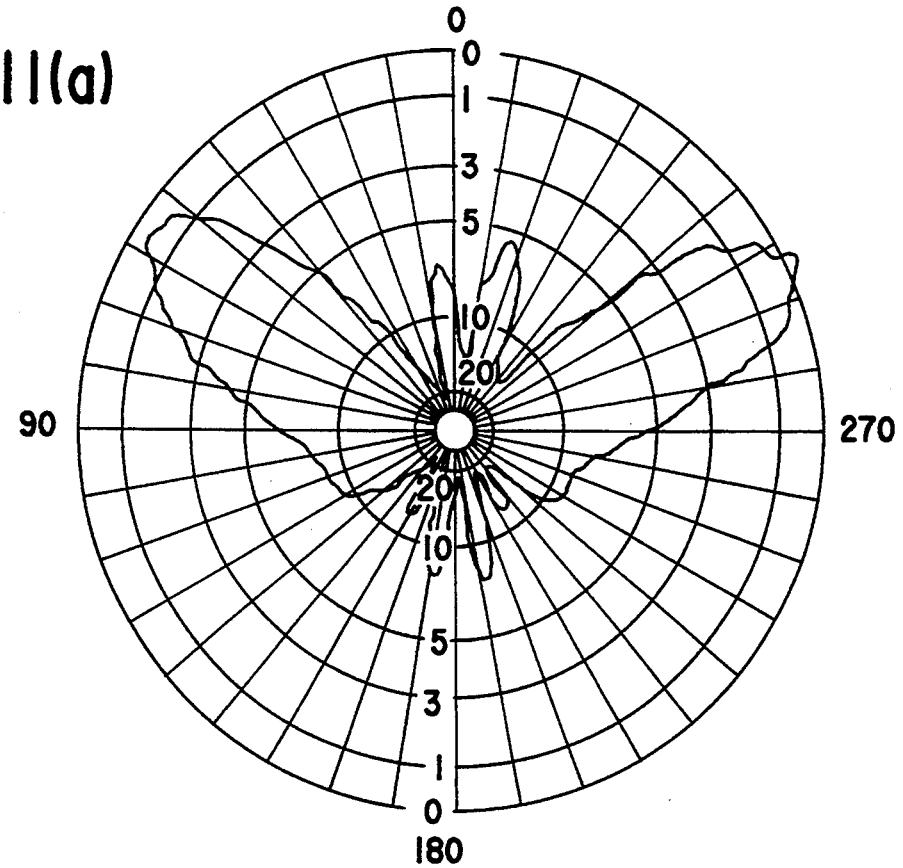
FIGS. 11(*a*)(*b*) shows the difference of perpendicular directivity between a roof antenna of the present invention and a conventional antenna for an exclusive wireless-telephone band.
Figure 11B:
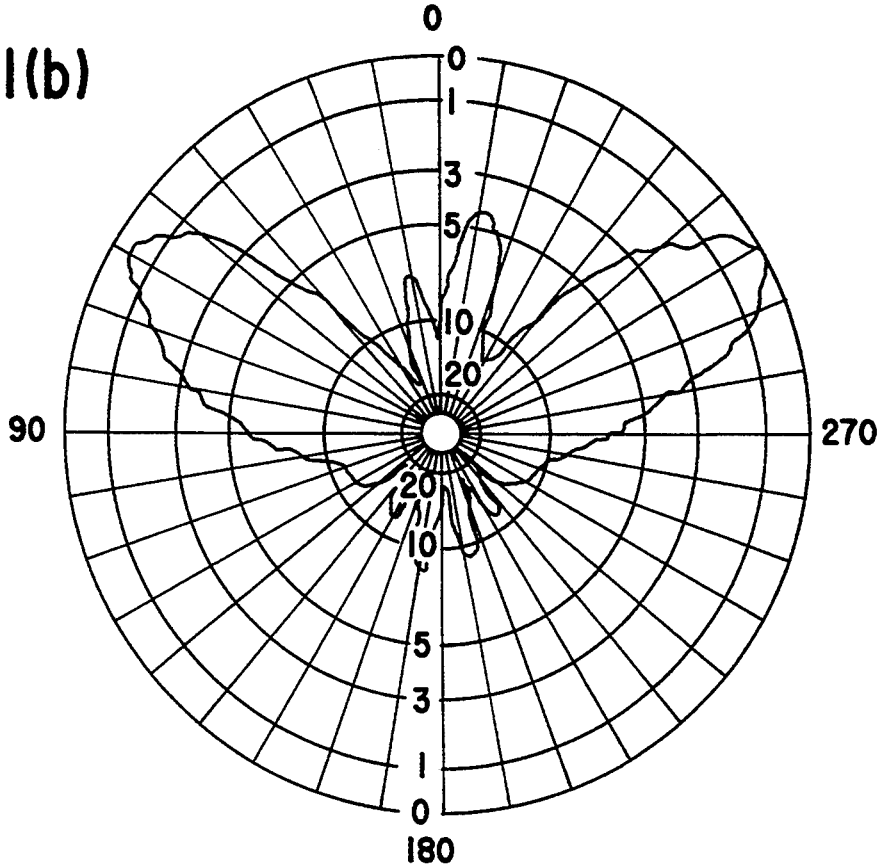

Further, FIGS. 11(*a*)(*b*) shows a perpendicular directivity when a frequency is 960 MHz. FIG. 11(*a*) shows the property of a roof antenna of the present invention. FIG. 11(*b*) shows the property of a conventional roof antenna only for a wireless telephone. The comparison shows that the roof antenna of the present invention has about the equal efficiency with a conventional antenna only for a wireless telephone though the antenna has a slight difference in the launch angle.

Thus, the antenna of the present invention shows properties as good as those of a conventional antenna, and thereby the present invention has a particular effect of the function. That is, it is not required to fix two antennas on the roof of a car or the like.

Since the roof antenna of the present invention has such a structure as described above, the antenna case can install a matching circuit, branching filters, and an amplifying unit though the antenna case is low and has a narrow inner space. Therefore, only the cable is led into a car and a space for installing an amplifying unit is not required inside a car. Further, an antenna element has a trap coil so that electricwaves in a wireless-telephone band can also be received by the antenna in the present invention, thereby the number of the antenna and the space for fixing the antenna can be reduced.

Furthermore, the structure gives an electrically stable connection and moisture does not penetrate into the cover because the metal fitting for connecting an antenna element is engaged with the connecting piece by push-and-lock system, and thereby a reliable electrical connection can be maintained.

What is claimed is:

1. A roof antenna capable of receiving three kinds of bands, comprising:

an antenna element having a trap coil in the middle thereof; and an antenna case, fixed on the roof of a car, including a branching filter means, amplifiers, and a mixer therein, wherein said antenna element is constituted so that an electric length from a bottom end of said antenna element to the trap coil is resonant with signals having a first frequency, an electric length of the whole antenna is resonant with signals having a second frequency, and an electric length of the whole antenna element receives signals having a third frequency;

said branching filter means branches and outputs said signals having the first frequency from three kinds of bands;

said signals having the second frequency and said signals having the third frequency branched by said branching filter means are amplified respectively by said amplifiers; and said amplified signals having the second frequency and the third frequency are mixed by said mixer and output from said antenna case.

2. A roof antenna capable of receiving three kinds of bands according to claim 1, wherein said branching filter means, said amplifiers, and said mixer are installed in said antenna case having a capacity of not more than about 30 cc.

3. A roof antenna capable of receiving three kinds of bands according to claim 1, wherein said antenna case includes at least two substrates, and wherein said branching filter means, said amplifiers and said mixer are mounted on said at least two substrates.

4. A roof antenna capable of receiving three kinds of bands comprising:

an antenna element having a trap coil in the middle thereof; and an antenna case having a portion for fixing said antenna element, said antenna case installing a substrate comprising a branching filter means, amplifiers and a mixer, and being fixed on the roof of a car, wherein said antenna element is constituted so that an electric length from a bottom end of said antenna element to said trap coil is resonant to signals having a first frequency, an electric length of the whole antenna is resonant with signals having a second frequency, and an electric length of the whole antenna element is resonant with signals having a third frequency; and said antenna case comprises a cover and a base;

a metal fitting having a depression is fixed substantially watertight at the top portion of said cover so that said depression is concave toward an outside of said antenna case;

said metal fitting has an internal engaging portion at the bottom thereof; and a metal connecting piece is electrically connected with said substrate fixed to said base;

an external engaging potion is formed at one end of a metal connecting piece by making cuts in radial directions to form tongues bent downward; and:

said cover is pressed to insert said internal engaging portion of said metal fitting for connecting the antenna element into said external engaging portion so that said metal fitting for connecting the antenna element is electrically connected to said substrate;

said branching filter means branches and outputs said signals having the first frequency from three kinds of bands;

said signals having the second frequency and said signals having the third frequency branched by said branching filter means are amplified respectively by said amplifiers; and said amplified signals having the second frequency and the third frequency are mixed by said mixer and output from said antenna case.

5. A roof antenna capable of receiving three kinds of bands according to claim 1 or 4, wherein said signals having the first frequency is for a wireless telephone band, said signals having the second frequency is for a FM radio band, and said signals having the third frequency is for an AM radio band.

6. A roof antenna capable of receiving three kinds of bands according to claim 5, wherein said branching filter means, said amplifiers, and said mixer are separately fixed on a plurality of substrates installed in said antenna case.

7. A roof antenna capable of receiving three kinds of bands according to claim 6, wherein said cover has a plurality of notches each having a shape of ring, said substrates abutting on said notches so that said substrates are installed nearly parallel to said base.

8. A roof antenna capable of receiving three kinds of bands according to claim 1 or 4, wherein said branching filter means, said amplifiers, and said mixer are separately fixed on a plurality of substrates installed in said antenna case.

9. A roof antenna capable of receiving three kinds of bands according to claim 8, wherein said cover has a plurality of notches each having a shape of ring, said substrates abutting on said notches so that said substrates are installed nearly parallel to said base.

10. A roof antenna capable of receiving three kinds of bands according to claim 4, wherein said branching filter means, said amplifiers, and said mixer are installed in said antenna case having a capacity of not more than about 30 cc.

11. A roof antenna capable of receiving three kinds of bands comprising:

an antenna case fixed on the roof of a car; and an antenna element capable of receiving three kinds of bands, fixed to said antenna case;

wherein said antenna case comprises a cover and a base;

a metal fitting portion for connecting the antenna element, having a depression is fixed watertightly at the top portion of said cover so that said depression faces the outside, said metal fitting having an internal engaging portion at the bottom thereof;

a metal connecting piece is electrically connected with a substrate fixed to said base;

an external engaging portion is formed at one end of said metal connecting piece by making cuts in radial directions so as to have tongues bent downward; and said cover is pressed to insert said internal engaging portion of said metal fitting for connecting the antenna element to said external engaging portion so that said metal fitting for connecting the antenna element is electrically connected to said substrate.

12. A roof antenna capable of receiving three kinds of bands according to claim 11, wherein said antenna element is constituted so as to receive signals having frequencies for a wireless telephone band, a FM radio band, and an AM radio band.

* * * * *